US009402520B2

(12) United States Patent
Sauer et al.

(10) Patent No.: US 9,402,520 B2
(45) Date of Patent: Aug. 2, 2016

(54) VACUUM CLEANING APPARATUS HAVING A VACUUM CLEANING UNIT AND A FILTER BAG

(71) Applicant: Eurofilters Holding N.V., Overpelt (BE)

(72) Inventors: Ralf Sauer, Overpelt (BE); Jan Schultink, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 0 days.

(21) Appl. No.: 14/383,022

(22) PCT Filed: Feb. 21, 2013

(86) PCT No.: PCT/EP2013/053462

§ 371 (c)(1),
(2) Date: Sep. 4, 2014

(87) PCT Pub. No.: WO2013/139552

PCT Pub. Date: Sep. 26, 2013

(65) Prior Publication Data

US 2015/0026918 A1 Jan. 29, 2015

(30) Foreign Application Priority Data

Mar. 22, 2012 (EP) ..... 12002041

(51) Int. Cl.
*A47L 9/14* (2006.01)
*A47L 9/28* (2006.01)

(52) U.S. Cl.
CPC ..... *A47L 9/14* (2013.01); *A47L 9/2821* (2013.01); *A47L 9/2842* (2013.01); *A47L 9/2857* (2013.01)

(58) Field of Classification Search
CPC ..... A47L 9/14; A47L 9/2857; A47L 9/2842
See application file for complete search history.

(56) References Cited

U.S. PATENT DOCUMENTS 4,021,879 A * 5/1977 Brigham ..... A47L 9/2821 15/319
6,156,086 A * 12/2000 Zhang ..... A47L 9/14 428/36.1
2008/0174105 A1 7/2008 Hyatt

FOREIGN PATENT DOCUMENTS

DE 44 13 225 A1 10/1995
DE 20 2005 000917 U1 4/2005

(Continued)

OTHER PUBLICATIONS

International Search Report mailed May 29, 2013 for International Application No. PCT/EP2013/053462.

*Primary Examiner* — Dung Van Nguyen
(74) *Attorney, Agent, or Firm* — Brinks Gilson & Lione

(57) ABSTRACT

The invention relates to a vacuum cleaning apparatus having a vacuum cleaning unit and a filter bag, in which the vacuum cleaning unit has a motor-fan unit which is designed in such a way that the vacuum cleaning unit with filter bag inserted with aperture 0 generates a negative pressure between 13 kPa and 6 kPa, preferably a negative pressure of between 20 kPa and 8 kPa and particularly preferably a negative pressure between 15 kPa and 8 kPa and, with aperture 8 (40 mm), generates an air flow between 25 l/s and 49 l/s, preferably an air flow between 30 l/s and 45 l/a, and particularly preferably an air flow between 35 l/s and 45 l/s, and the filter bag is a disposable filter bag made of nonwoven material which, during the testing of the reduction in the maximum air flow with a partially filled dust container analogous to EN 60312, exhibits a reduction in the air flow of less than 15%, preferably less than 10%, particularly preferably less than 5%.

18 Claims, 7 Drawing Sheets

(56) References Cited

FOREIGN PATENT DOCUMENTS

| | | | |
|---|---|---|---|
| DE | 20 2006 016303 | U1 | 12/2006 |
| DE | 20 2006 016304 | U1 | 1/2007 |
| DE | 20 2006 019108 | U1 | 3/2007 |
| DE | 20 2007 010692 | U1 | 11/2007 |
| DE | 10 2007 046373 | A1 | 4/2008 |
| DE | 20 2008 007717 | U1 | 9/2008 |
| DE | 10 2007 059930 | B3 | 2/2009 |
| DE | 20 2008 016669 | U1 | 3/2009 |
| DE | 20 2008 016300 | U1 | 4/2009 |
| DE | 10 2007 060747 | A1 | 6/2009 |
| DE | 10 2008 006 769 | A1 | 8/2009 |
| DE | 20 2009 002970 | U1 | 12/2009 |
| EP | 0 042 723 | A2 | 12/1981 |
| EP | 0 960 645 | A2 | 12/1999 |
| EP | 1 787 560 | A1 | 5/2007 |
| EP | 1 915 938 | A1 | 4/2008 |
| EP | 1 997 417 | A2 | 12/2008 |
| EP | 2 366 319 | A1 | 9/2011 |
| EP | 2 366 320 | A1 | 9/2011 |
| EP | 2 366 321 | A1 | 9/2011 |
| EP | 2 428 151 | A1 | 3/2012 |
| WO | WO 2005/060807 | A1 | 7/2005 |
| WO | WO 2007/059939 | A1 | 5/2007 |
| WO | WO 2007/121979 | A1 | 11/2007 |
| WO | WO 2008/000829 | A1 | 1/2008 |
| WO | WO 2010/000453 | A1 | 1/2010 |

* cited by examiner

PRIOR ART

Fig. 3: Reduction of the air flow when sucking in 400gr test dust DMT8 analogous to EN 60312 with a rated input of 2200 W (Miele S5210) and 1400 W (Dyson DC23 alergy)

PRIOR ART

Fig. 4: Air parameters of a motor-fan unit with high rated input

Fig. 5: Air parameters of a motor-fan unit for use according to a preferred embodiment of the present invention Fig. 6: Vacuum cleaner with a high constant suction capacity and input power of below 1000 W

VACUUM CLEANING APPARATUS HAVING A VACUUM CLEANING UNIT AND A FILTER BAG

This application claims the benefit under 35 U.S.C. §371 of International

Application No. PCT/EP2013/053462, filed Feb. 21, 2013, which claims the benefit of European Patent Application No. 12002041.7, filed Mar. 22, 2012, which are incorporated by reference herein in their entirety.

FIELD OF THE INVENTION

The invention relates to a vacuum cleaning apparatus having a vacuum cleaning unit and a filter bag made of nonwoven material.

DEFINITIONS

The description of prior art and the invention are based on the following standards, below definitions and the following measurement methods.

EN 60312: EN 60312 refers to the Standard in the version EN 60312:1998+A1: 2000+A2: 2004.

EN 60335: EN 60335 refers to the Standard in the version EN 60335-2-2:2010.

Determination of air data: The air data of a vacuum cleaner is determined according to EN 60312 section 2.8. The measuring device B in section 5.2.8 is presently used. Where motor-fan units are measured apart, i.e. without the vacuum cleaner housing, then measuring device B is also used.

Measurement of the reduction of the maximum air flow in partially filled vacuum cleaner container in accordance with section 2.9 is performed with aperture 8 (40 mm).

Nominal electrical rated input of a vacuum cleaner: The input power of a vacuum cleaner is determined according to EN 60335. According to EN 60335 and EN 60312, the input power is denoted by $P_1$. The nominal rated input is according to EN 60335 the arithmetic mean of the maximum input power and the minimum input power. The maximum input power is measured at the maximum air flow (open air flow) and the minimum input power at an air flow of 0 l/s (sealed suction). Electric motor-powered attachment devices such as brushes and the like are not considered when determining the input power.

Air flow: The air flow is determined according to EN 60312 with the measuring chamber according to Version B. In prior art, this air flow is often referred to as volume flow or suction air flow.

Air flow drop, constant air flow: The air flow drop is determined in the framework of suitability for use tests of vacuum cleaners in accordance with EN 60312 (section 2.9 of this standard) with the measuring chamber Version B. Deviating from the Standard, the drop of the air flow is examined by sucking in 400 g DMT8 test dust in 50 g portions, provided that the maximum usable volume of the filter bag (see Section 2.7 of this Standard) lies above 2 l. The three conditions that are according to section 2.9.1.3 of the Standard to lead to termination of the examination are not considered. For volumes below 2 l, the approach according to section 2.9.1.3 is used. This method for measuring the air flow drop, being modified as compared to Standard EN 60312, is in the present description and the present claims referred to as "analogous to EN 60312".

A constant air flow q is given when the air flow $q_c$ after sucking in the test dust DMT8 is not lower than the air flow $q_{max}$ with an empty dust container (cyclone vacuum cleaner) or with an empty filter bag (bag vacuum cleaner). The 400 g test dust DMT8 is typically sucked in 50 g portions. The test is performed using aperture 8 (40 mm) EN 60312, section 5.2.8.2 is made reference to for the definition of an aperture. This aperture corresponds to a relatively open floor nozzle. The air flow drop is calculated by using:

$$\text{Air flow drop } [\%]=((q_{max}-q_c)/q_{max})\times 100$$

$q_{max}$=maximum air flow with empty dust container $q_c$=maximum air flow with a partially filled dust container.

A substantially constant flow of air in the present description of prior art and the invention does not mean, however, that the air flow remains constant in different work situations, such as vacuuming carpeting or hard floors or vacuuming with accessories nozzles. Due to the different opening area of these nozzles and due to the different degree of reduction in this opening area on different floor coverings, different air flows result depending on the work situation. In relation to EN 60312, this would correspond to the test with different apertures. Where aperture 0 corresponds to the condition of a clogged nozzle Aperture 9 (50 mm) corresponds to nearly unobstructed inflow. Common floor nozzles typically have an operating point in the range of aperture 7 (30 mm) to 8 (40 mm).

Power increase of the fan motor: Power increase of the fan motor is understood to mean an increase in the input power [W]. With a universal motor, power adjustment is done by phase-angle control. With the SR motor (see below), the control voltage of the motor is adjusted.

SR motor: An SR motor is a switched reluctance motor that is characterized by a simple and robust construction and high potential rotational speeds (>100,000 rpm). The torque is generated by the reluctance force.

Flat bag: A flat bag is within the meaning of the present invention understood as being filter bags whose filter bag wall is formed of two single layers of filter material having the same surface area such that the two individual layers are joined only at their peripheral edges to each other (the term same surface area of course does not exclude that the two individual layers differ from each other, that one of the layers has an entry opening).

The connection of the individual layers can be implemented by a weld or adhesive seam along the entire circumference of the individual layers; but it can be formed also in that a single layer of filter material is folded around one of its axes of symmetry and the remaining open peripheral edges of the resulting two partial layers are welded or glued (so-called tubular bag). Such manufacturing therefore requires three weld or glue seams. Two of these seams then form the filter bag edge, the third seam can also form a filter bag edge or be located on the filter bag surface.

Flat bags within the meaning of the present invention can also comprise so-called side folds. These side folds can there be completely folded apart. A flat bag with such side folds is shown, for example, in DE 20 2005 000 917 U1 (see there FIG. 1 with folded side folds and FIG. 3 with side folds folded apart). Alternatively, the side folds can be welded to portions of the peripheral edge. Such a flat bag is shown in DE 10 2008 006 769 A1 (cf. there in particular FIG. 1).

Surface folds: A filter bag whose filter bag wall has surface folds is known per se from prior art, for example from the European patent application 10163463.2 (cf. in particular FIG. 10A and FIG. 10B or FIG. 11A and FIG. 11B, respectively). If the filter bag wall comprises a plurality of surface folds, then this material is also referred to as pleated filter material. Such pleated filter bag walls are shown in European Patent Application 10002964.4.

FIGS. 1 and 2 show a filter bag in cross-section with a wall that comprises two surface folds. With such surface folds, the filter surface area of the filter bag is increased resulting in a higher dust collecting capacity of the filter bag at a higher separation capacity and a longer service life (in each case with respect to a filter bag with the same outer dimensions and with no surface folds).

FIG. 1 illustrates a filter bag 1 with a bag filter wall 10 which has two surface folds 11 in the shape of so-called dovetail folds. The filter bag is there shown in a cross-section through the center of the filter bag. The longitudinal axes of the surface folds therefore extend in a plane which in turn is perpendicular to the drawing plane, and the surface folds at their longitudinal ends turn into the weld seams of the filter bag extending in parallel to the drawing plane and located in front of and behind the drawing plane. The surface folds can thereby be folded apart to the strongest degree at their center. The filter bag is there shown in a state in which the surface folds are already somewhat folded apart.

FIG. 2 illustrates a filter bag 2 with a bag filter wall 20 which has two surface folds 21 in the shape of so-called triangular folds. The filter bag is there shown in a cross-section through the center of the filter bag. The longitudinal axes of the surface folds therefore extend in a plane which in turn is perpendicular to the drawing plane, and the surface folds at their longitudinal ends turn into the weld seams of the filter bag extending in parallel to the drawing plane and located in front of and behind the drawing plane. The surface folds can thereby be folded apart to the strongest degree at their center. The filter bag is there likewise shown in a state in which the surface folds are already somewhat folded apart.

In addition to the surface folds shown in FIG. 1 and FIG. 2, surface folds having other shapes are also possible. The fact that the surface folds in the embodiments according to FIG. 1 and FIG. 2, the surface folds [sic] extend perpendicular to a bag edge is not to be understood as a restriction. The surface folds can of course also extend at an angle to the bag edges.

Suction capacity: The suction capacity is the product of the negative pressure [kPa] and the air flow [l/s]. The suction capacity is according to EN 60312 denoted by $P_2$.

Degree of efficiency: The degree of efficiency of a vacuum cleaner or a motor-fan unit is determined according to EN 60312 section 2.8.3.

PRIOR ART

The demands being placed on vacuum cleaning apparatuses have in recent years undergone significant change.

The study of the "AEA Energy & Environment Group" on behalf of the "European Commission Energy" for defining the requirements of an eco design for vacuum cleaners shows that it would be desirable that the input power should in future for reasons of energy policy be restricted to less than 1100 W. The users of vacuum cleaning apparatuses, however, expect that the cleaning performance does not reduce significantly as compared to vacuum cleaning devices that are today available with a much higher input power.

The customer demands regarding hygiene of a vacuum cleaning apparatus no longer relate only to the lowest possible dust emission of the apparatuses but also to the hygienic disposal of the collected dust.

In terms of the separation concept, vacuum cleaners without filter bags and vacuum cleaners with filter bags can be distinguished. These apparatuses each have typical advantages and disadvantages.

Vacuum cleaners with filter bags are characterized by a high air flow. When the filter bag is increasingly filled, however, the air flow is reduced to a higher or lesser degree. Until about the year 2000, filter bags made of paper were primarily used. When testing the reduction of the maximum air flow with a partially filled dust container analogous to EN 60312, such paper filter bags show an air stream drop of about 80% (or 60% when using an inner tissue, respectively). Filter bags with non-woven material layers subsequently began slowly establishing themselves. Filter bags with non-woven material layers having a low dust collecting capacity were first used (SMS filter bag). With the introduction of filter bags made of non-woven materials having a capacity layer, this drop of air flow could be significantly reduced (see EP 0 960 645). When testing the reduction of the maximum air flow with a partially filled dust container analogous to EN 60312, such filter bags show an air stream drop of about 30%. Further improvements were achieved with pre-filtration using loose fibers in the bag (DE 10 2007 060 747, DE 20 2007 010 692 and WO 2005/060 807), or pre-separation by a bag in a bag (WO 2010/000453, DE 20 2009 002 970 U1 and DE 20 2006 016 303 U1). Flow deflections or flow distributions in the filter bag are proposed in EP 1915 938, DE 20 2008 016 300, DE 20 2008 007 717 U1 (dust holding insert), DE 20 2006 019 108 U1, DE 20 2006 016 304 U1, EP 1 787 560 and EP 1 804 635. When testing the reduction of the maximum air flow with a partially filled dust container analogous to EN 60312, an air flow drop of about 15% can be obtained with such filter bags. Further improvement of the constancy of the suction capacity is therewith achieved. European patent applications 10002964.4, 10163463.2, and 10163462.2 disclose improved dust-holding capacity by pleating the filter material or by providing the filter bag with so-called surface folds. European patent application 10009351.7 shows how optimized positioning of the bag in the vacuum cleaner can improve the constancy of the suction capacity. When testing the reduction of the maximum air flow with a partially filled dust container analogous to EN 60312, such filter bags show an air stream drop of about 5%.

With regard to the hygienic disposal of the dust sucked up, holding plates have been developed with which the filter bag is manually, semi-automatically or automatically sealed prior to removal from the vacuum cleaner (e.g., EP 2 012 640).

Bagless vacuum cleaners—in particular cyclone vacuum cleaners—are indeed characterized by the air flow remaining substantially constant when the dust collection container fills with dust. The constant air flow of a cyclone vacuum cleaner is at a first glance an advantage compared to vacuum cleaners with filter bags that clog to a greater or lesser degree when the filter bag is increasingly filled, whereby the air flow is reduced accordingly. This, however, is offset by a very high electric nominal rated input of the cyclone vacuum cleaners. This high rated input is required due to the high losses being caused by the separation principle, namely the loss for maintaining the high rotational speed of the dust-laden air in the cyclone separator.

It was by combining multiple cyclone separators to multi-stage cyclones attempted to increase the degree of efficiency and the separation performance (EP 0042723). An air flow of 33 l/s can be achieved with such vacuum cleaning apparatuses. However, this is offset by a nominal rated input of over 2000 W. With cyclone vacuum cleaners having an electrical rated input of 1400 W, an air flow of 25 l/s can be realized.

With conventional vacuum cleaning apparatuses having filter bags, an air flow of about 40 l/s can nowadays be achieved with newly inserted and unfilled filter bags. Such vacuum cleaners have a nominal rated input of about 1300 W.

However, the air flow is greatly reduced when filled with dust, as can be seen in FIG. 3 FIG. 3 shows the reduction of the air flow in relation to the quantity of DMT 8 dust sucked in analogous to EN 60312 for known apparatuses with filter bags (for example, Miele S5210 with a nominal electrical rated input of 2200 W and various filter bags made of nonwoven material), and without filter bags (Dyson DC23 alergy with a nominal electrical rated input of 1400 W).

In addition to the improvements to the filter bags, there are some approaches for vacuum cleaners with filter bags to achieve a constant air flow by using an electronic control device.

U.S. Pat. No. 4,021,879 shows a vacuum cleaning apparatus, the vacuum cleaning unit of which comprises a control device with which the vacuum cleaning unit is controlled such that a substantially constant air flow is realized. In this apparatus, however, filter bags made of paper are used. However, due to the high clogging tendency of filter bags made of paper (approx. 80% air flow drop for 400 g DMT8; inner tissues were at the time of publication of U.S. Pat. No. 4,021,879 not yet used), a very large control range must be provided for the nominal electrical rated input. While a constant air flow is thereby theoretically possible, it is very low. For this reason, this concept was no longer pursued and could therefore not be implemented in the market as a successful product.

DESCRIPTION OF THE INVENTION

Given the aforementioned drawbacks of prior art, the invention is based on the object to provide a vacuum cleaning apparatus having a vacuum cleaning unit and filter bags, in which the nominal electrical rated input is significantly reduced, while the cleaning performance may not be reduced substantially as compared to vacuum cleaning devices that are available today with a much higher rated input.

This object is satisfied by a vacuum cleaning apparatus having the features of claim 1, i.e. by a vacuum cleaning apparatus having a vacuum cleaning unit and a filter bag, in which the vacuum cleaning unit has a motor-fan unit which is designed in such a way that the vacuum cleaning unit with filter bag inserted with aperture 0 generates a negative pressure between 30 kPa and 6 kPa, preferably a negative pressure of between 20 kPa and 8 kPa and particularly preferably a negative pressure between 15 kPa and 8 kPa and, with aperture 8 (40 mm), generates an air flow between 25 l/s and 49 l/s, preferably an air flow between 30 l/s and 45 l/s, and particularly preferably an air flow between 35 l/s and 45 l/s, and in which the filter bag is a disposable filter bag made of nonwoven material which, during the testing of the reduction in the maximum air flow with a partially filled dust container analogous to EN 60312, exhibits a reduction in the air flow of less than 15%, preferably less than 10%, particularly preferably less than 5%.

This particular characteristic of the motor-fan unit is different from the characteristic of motor-fan units conventionally used in vacuum cleaning apparatuses to the effect that the latter produce a significantly higher negative pressure and provide a significantly lower maximum air flow.

Surprisingly, it has been found that such motor-fan units are employed in a particularly energy-saving manner, and together with the disposable filter bags made of nonwoven material exhibiting reduction of the air flow, i.e. an airflow drop of less than 15%, are in their cleaning performance comparable with vacuum cleaning devices as they are available nowadays with significantly higher rated input.

According to a particularly preferred embodiment of the invention described above, the vacuum cleaning unit can with aperture 8 (40 mm) have an air flow rate of more than 250 W, preferably of more than 300 W, particularly preferably of more than 350 W. When the invention is thus embodied, fully satisfactory vacuuming operation across the entire filling operation of the filter bag can be guaranteed.

The inventions described above can be further developed to the extent that the vacuum cleaning unit has a nominal electrical rated input of less than 1200 W, preferably less than 1100 W, particularly preferably less than 900 W. Such rated inputs fully comply also with future energy policy requirements.

Preferably, the motor-fan unit can with aperture 8 (40 mm) exhibit a degree of efficiency according to EN 60335 of at least 20%, preferably of at least 25% and particularly preferably of at least 30%. This development of the invention leads to particularly energy-saving vacuum cleaning apparatuses.

According to a preferred embodiment of all previously discussed inventions, the apparatus can comprise a control device that controls the vacuum cleaning unit such that the air flow is maintained substantially constant at a value of at least 34 l/s when the filter bag is filled with DMT8 test dust analogous to EN 60312, preferably is maintained substantially constant at a value of at least 37 l/s, particularly preferably maintained substantially constant at a value of at least 40 l/s.

An essential characteristic that is expected by users of vacuum cleaning apparatuses can be realized according to this preferred development, namely that the vacuum cleaning apparatus generates a constant air flow even when increasingly being filled with dust, or in other words, that the vacuum cleaning apparatus exhibits no air flow drop when increasingly being filled with dust.

This embodiment is based on the concept that a vacuum cleaning apparatus having a filter bag is with an empty filter bag operated at an input power that is set lower than the maximum power of the motor so that the input power to the motor can be increased correspondingly to the increased filling level of the filter bag. It has surprisingly shown that only a relatively small increase in the input power to the motor is required with filter bags having a tendency to clog of less that 15%, preferably having a tendency to clog of less than 10%, particularly preferably having a tendency to clog of less than 5%, in order to maintain constant the air flow at a level required for efficient vacuum cleaning, i.e. at least at 34 l/s. A vacuum cleaning apparatus could thereby be realized that can provide a substantially constant volume flow while the filter bag is continuously filled while simultaneously maintaining the maximum electrical input power to the vacuum cleaner below a predetermined value—which is acceptable from the perspective of power consumption—of 1200 W.

According to a development of the invention described in the last three paragraphs, the vacuum cleaning apparatus comprises an electronic control device which is configured such that it controls the electrical power input for the motor-fan unit.

The apparatus is preferably then designed such that the increase of power input for the motor-fan unit required to maintain the substantially constant air flow when filling the filter bag with DMT8 dust analogous to EN 60312 is not more than 35%, preferably no more than 20% and particularly preferably no more than 15%, relative to the power input for the motor-fan unit when the filter bag is empty. According to this embodiment, vacuum cleaning apparatuses having a constant air flow can be achieved with a suction behavior as it is known from today's non-controllable apparatuses, while future energy policy specifications can be easily complied with.

Particularly suited for such an apparatus is a motor-fan unit comprising a reluctance motor, preferably a switched reluctance motor. Such motors are characterized in particular by the fact that they are sturdy and durable.

Alternatively, an apparatus can be provided in accordance with another preferred embodiment of the invention in which the control device comprises a throttle valve which regulates the air flow such that it is substantially constant.

As control variables, the negative pressure downstream of the filter bag, the negative pressure upstream of the filter bag, or the flow speed measured at an arbitrary point in the flow path can in the two alternative developments of the control device be used as control variables. Any combinations of these three variables are also possible.

According to a preferred embodiment of all inventions described above, the filter bag can be provided in the shape of a flat bag. The flat bag shape is the most common form for non-woven bags, because bags with this shape are very easy to produce. In contrast to the paper filter material used for filter bags made of paper, non-woven filter material is very difficult to fold permanently due to the high return resilience so that the production of more complex bag shapes, such as of block bottom bags or other bag shapes with a bottom, is very complicated and expensive.

Particularly suitable for the use in the apparatus according to the invention are vacuum cleaner bags with pleated filter material or with surface folds. Such vacuum cleaner bags are characterized by a particularly low air flow drop.

According to another development of all previously described inventions, the vacuum cleaning unit can comprise a filter bag replacement indicator indicating when the air flow falls below a substantially constant value for a predetermined time during the vacuuming operation. In particular those sensors that are already provided for measuring the control variables can be used for this.

According to another preferred development of the invention described above, the filter bag has a volume measured according to EN 60312 in a range of 1.5 L to 8 L. Such filter bags are mainly used in vacuum cleaning units that are designed as floor vacuum cleaners, as hand vacuum cleaners, as canister vacuum cleaners or as upright for domestic use.

BRIEF DESCRIPTION OF THE FIGURES

The figures serve to illustrate prior art and the invention.

EMBODIMENTS OF THE INVENTION

Figure 5:
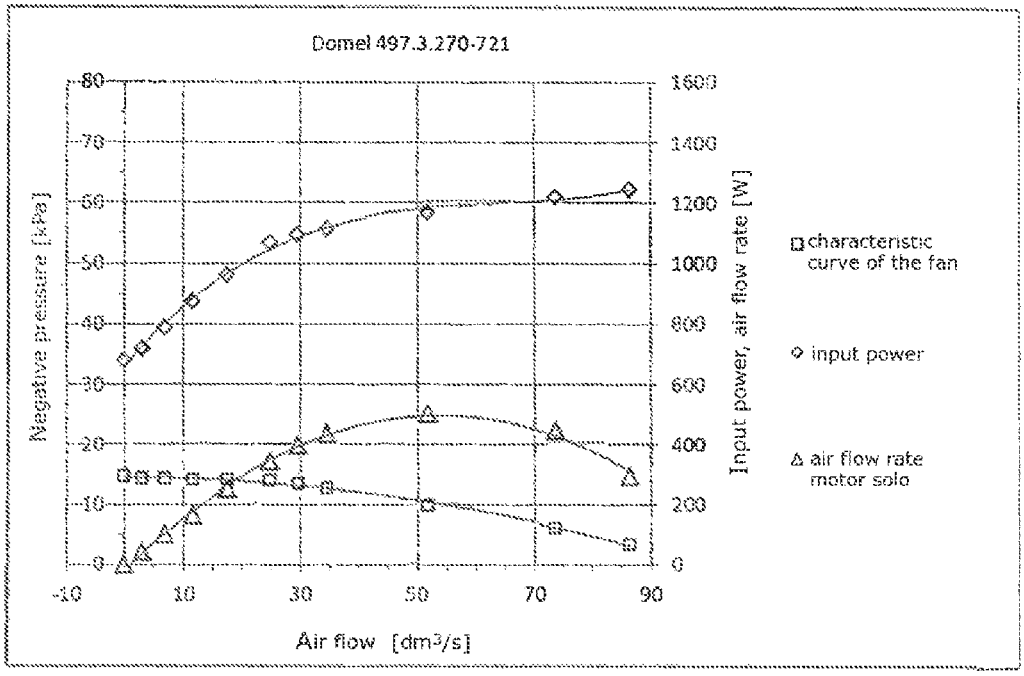
FIG. 5: shows the air parameters for a motor-fan unit which is according to prior art not used in apparatuses for vacuum cleaning and is particularly suitable for implementing the present invention.

FIG. 5 shows the characteristic curve of the motor-fan unit according to one embodiment of the invention. It is characterized by comparatively low maximum negative pressure with aperture 0 and a high volume flow with aperture 9 (50 mm). In particular, with aperture 0, a negative pressure of 14.3 kPa is reached. With aperture 9 (50 mm), an air flow of 86.5 $dm^3/s$ results. The characteristic curve is therefore very flat. At the maximum air flow, the engine inputs 1240 W of power. The air flow rate (product of the negative pressure and the air flow) amounts to a maximum of 498 W with aperture 7 (30 mm).

Figure 1:
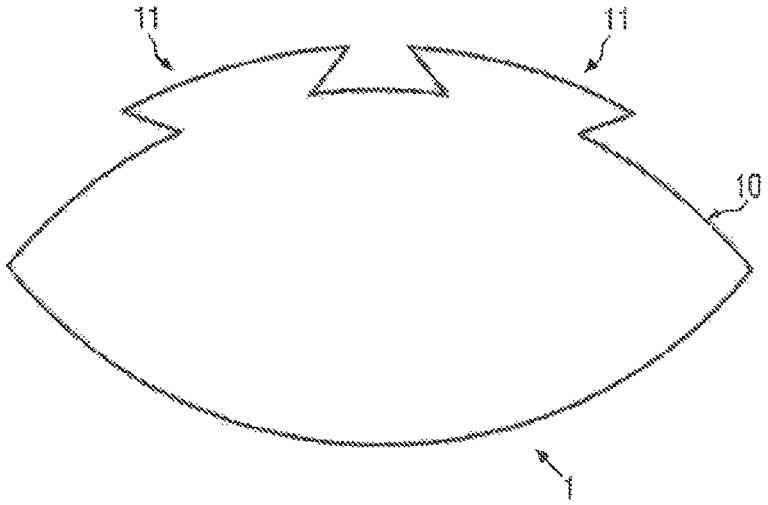
FIG. 1 PRIOR ART
FIG. 1.
Figure 2:
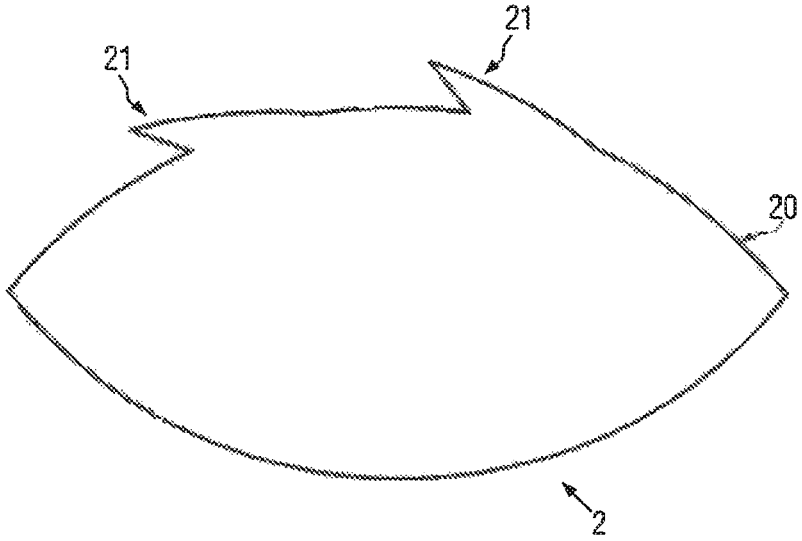
FIG. 2 PRIOR ART
FIG. 2: show filter bags according to prior art with surface folds.
Figure 3:
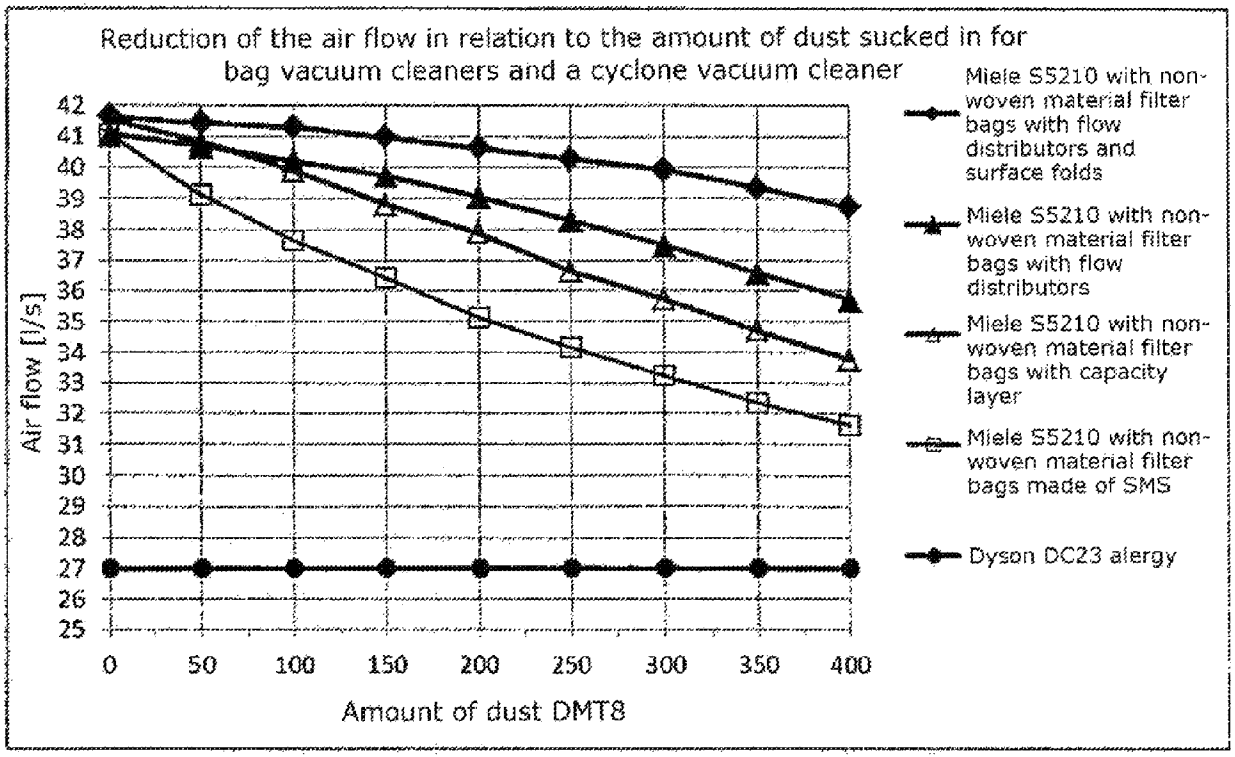
FIG. 3: shows the reduction in the air flow for vacuum cleaning apparatuses having vacuum cleaning units and filter bags according to prior art and for a vacuum cleaning apparatus without a filter bag according to prior art.
Figure 4:
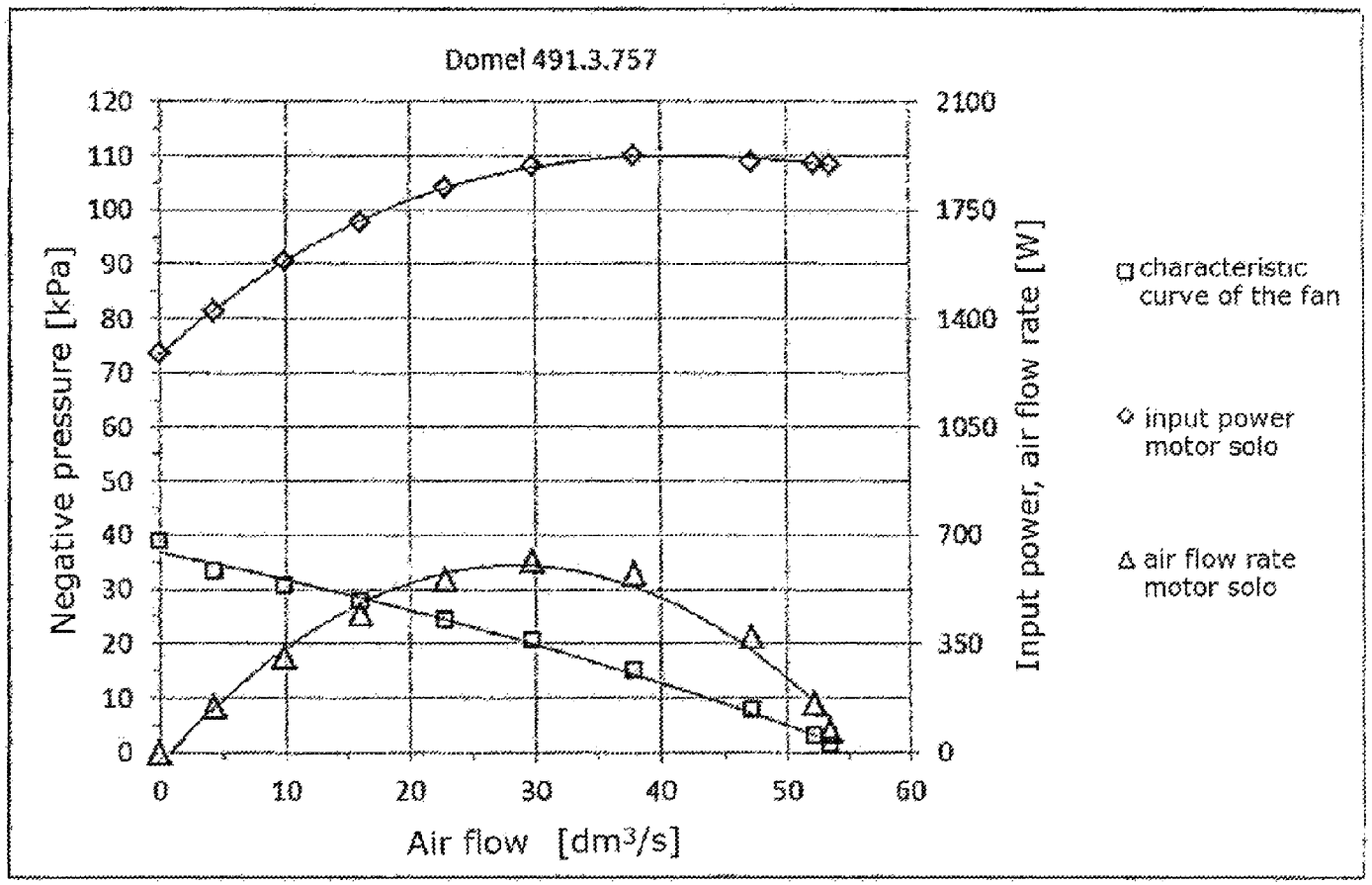
FIG. 4: shows the air parameters for a motor-fan unit which is according to prior art used in apparatuses for vacuum cleaning.

FIG. 4, however, shows the characteristic data for a motor-fan unit as used in prior art for vacuum cleaning apparatuses With aperture 0, the motor-fan unit reaches a negative pressure of 35.8 kPa, with aperture of 9 (50 mm) an air flow of $53.5\ ^3/s$ results. The characteristic curve of the fan is therefore very steep. At the maximum air flow, the engine inputs 1900 W of power. The air flow rate reaches 614 W. With heavily clogging filter bags made of paper, such a configuration was very necessary and useful.

In the particularly preferred embodiment according to the present invention, filter bags are used having surface folds, as described in the above section DEFINITIONS.

Figure 6:
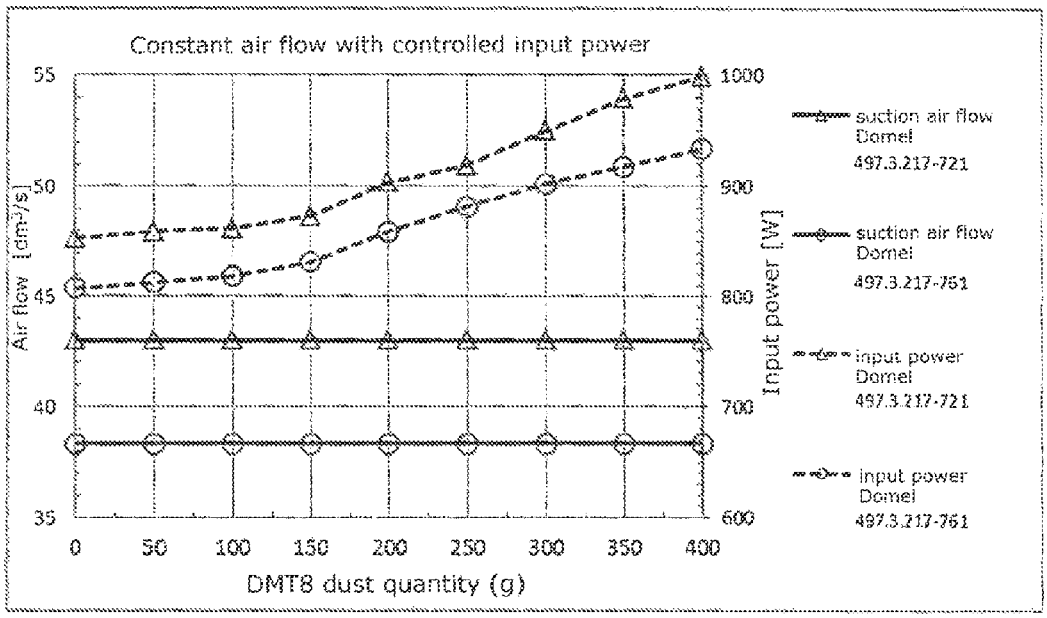
FIG. 6: shows the air flow and electrical input power of a first and a second embodiment of the present invention.
Figure 7:
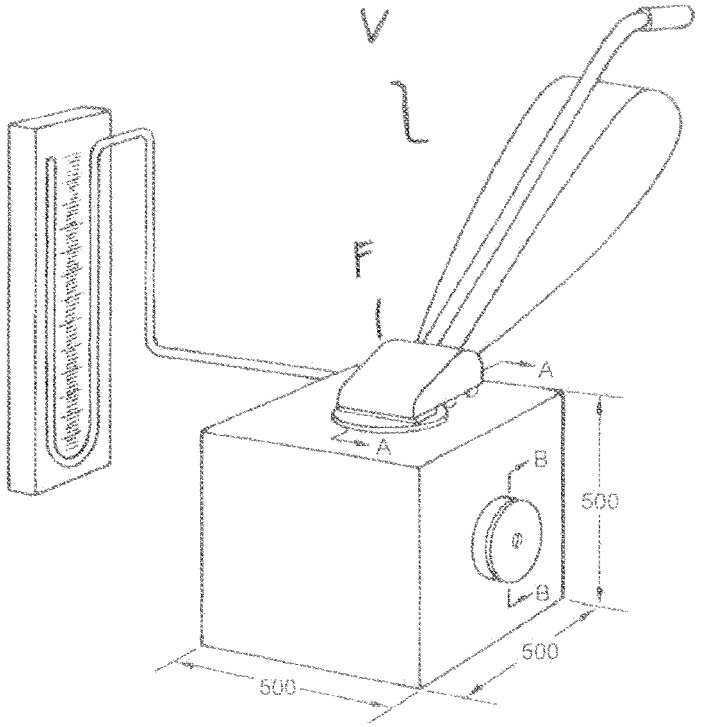
FIG. 7: shows a vacuum cleaning apparatus positioned on a measuring chamber. The vacuum cleaning apparatus includes a vacuum cleaning unit (V) and a motor-fan unit (F).

With the motor-fan unit shown in FIG. 5, a vacuum cleaner having an input power of below 1000 W and a high constant air flow can be realized in combination with a filter bag with surface folds and an installation space adapted to the filter bag and comprising a respective automatic control of the air flow. FIG. 6 shows the results for two embodiments according to the present invention. Both have in common that a very high constant air flow is achieved at low electrical input power.

The invention claimed is:

1. A vacuum cleaning apparatus having a vacuum cleaning unit and a filter bag in which said vacuum cleaning unit has a motor-fan unit which is designed in such a way that said vacuum cleaning unit with filter bag inserted with aperture 0 generates a negative pressure between 30 kPa and 6 kPa and which with aperture 8 (40 mm) generates an air flow between 25 l/s and 49 l/s, and said filter bag is a disposable filter bag made of nonwoven material and comprising a pleated filter material or surface folds and which, during testing of a reduction in a maximum air flow with a partially filled dust container, exhibits a reduction in the air flow of less than 15%, wherein the testing of the reduction in the maximum air flow is perfomed according to EN 60312 with the modification that the air flow is examined by sucking in 400 g DMT8 test dust in 50 g portions, if the maximum usable volume of the filter bag lies above 2 l.

2. The apparatus according to claim 1, wherein said vacuum cleaning unit with aperture 8 (40 mm) has an air flow rate of more than 250 W.

3. The apparatus according to claim 1, wherein said vacuum cleaning unit has a nominal electrical rated input of less than 1200 W.

4. The apparatus according to claim 1, wherein said motor-fan unit with aperture 8 (40 mm) exhibits a degree of efficiency according to EN 60335 of at least 20%.

5. The apparatus according to claim 1, wherein the air flow is maintained substantially constant at a value of at least 34 l/s when said filter bag is filled with the test dust DMT8.

6. The apparatus according to claim 5, wherein a negative pressure downstream of said filter bag of said vacuum cleaning unit or a negative pressure upstream of said filter bag of said vacuum cleaning unit is used as a control variable.

7. The apparatus according to claim 5, wherein a flow speed measured at an arbitrary point in the flow path is used as a control variable.

8. The apparatus according to claim 1, wherein an increase of power input of said motor-fan unit required to maintain a substantially constant air flow, when filling said filter bag with the DMT8 test dust, is no more than 35%, relative to a power input of said motor-fan unit when said filter bag is empty.

9. The apparatus according to claim 1, wherein said motor-fan unit comprises a reluctance motor.

10. The apparatus according to claim 1, wherein said filter bag is designed as a flat bag.

11. The apparatus according to claim 1, wherein said filter bag comprises surface folds.

12. The apparatus according to claim 1, wherein said filter bag has a volume measured according to EN 60312 in the range of 1.5 l to 8 l.

13. The apparatus according to claim 1, wherein with aperture 0 generates the negative pressure of between 20 kPa and 8 kPa.

14. The apparatus according to claim 1, wherein with aperture 0 generates the negative pressure of between 15 kPa and 8 kPa.

15. The apparatus according to claim 1, wherein with aperture 8 (40 mm) generates the air flow between 30 l/s and 45 l/s.

16. The apparatus according to claim 1, wherein with aperture 8 (40 mm) generates the air flow between 35 l/s and 45 l/s.

17. The apparatus according to claim 1, wherein the filter bag exhibits a reduction in the air flow of less than 10%.

18. The apparatus according to claim 1, wherein the motor-fan unit comprises a flat characteristic curve of negative pressure versus air flow.

* * * * *